US008519627B2

(12) United States Patent
Jeong et al.

(10) Patent No.: US 8,519,627 B2
(45) Date of Patent: Aug. 27, 2013

(54) FIELD EMISSION DEVICE

(75) Inventors: Jin Woo Jeong, Daejeon (KR); Yoon Ho Song, Daejeon (KR); Dong Il Kim, Daejeon (KR); Jun Tae Kang, Daegu (KR); Ji Seon Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 600 days.

(21) Appl. No.: 12/502,810

(22) Filed: Jul. 14, 2009

(65) Prior Publication Data

US 2010/0156305 A1 Jun. 24, 2010

(30) Foreign Application Priority Data

Dec. 18, 2008 (KR) ..... 10-2008-0129659

(51) Int. Cl.
*G09G 3/10* (2006.01)

(52) U.S. Cl.
USPC ..... 315/169.1; 315/169.3

(58) Field of Classification Search
USPC ..... 315/169.4, 169.1, 337, 167, 168; 313/495–497; 345/55, 60–62, 74.1–75.2
See application file for complete search history.

(56) References Cited

U.S. PATENT DOCUMENTS 6,060,840 A * 5/2000 Foo et al. ..... 315/169.1
6,118,417 A * 9/2000 Hush ..... 313/495
7,049,753 B2 * 5/2006 Rasmussen ..... 315/169.3
7,067,984 B2 * 6/2006 Rasmussen ..... 315/169.3
7,122,967 B2 * 10/2006 Jo et al. ..... 315/169.1
8,018,169 B2 * 9/2011 Jeong et al. ..... 315/169.3
2005/0110393 A1 * 5/2005 Han et al. ..... 313/495
2006/0290259 A1 * 12/2006 Song et al. ..... 313/495
2007/0057283 A1 3/2007 Shiozaki et al.
2007/0085778 A1 * 4/2007 Yoshida ..... 345/75.2

FOREIGN PATENT DOCUMENTS

EP 1 443 538 8/2004
JP 2006-338935 12/2006
KR 2005-0020518 3/2005
KR 10-2007-0098490 A 10/2007
KR 2008-0017241 2/2008

OTHER PUBLICATIONS

"Dynamic CNT Field Emission Lamp", Soc Fair 2008 Exhibition & Conference (Oct. 14, 2008-Oct. 17, 2008).
Jin-Woo Jeong et al., "15-in. Dynamic Field Emission BLU for LCD", IDW '08. The 15th International Display Workshops. pp. 2019-2020.

* cited by examiner

*Primary Examiner* — Minh D A
(74) *Attorney, Agent, or Firm* — Rabin & Berdo, P.C.

(57) ABSTRACT

Provided is a field emission device having a simple structure and capable of pulse driving and local dimming. The field emission device turns a current flowing from each cathode electrode block on or off in response to a switching control signal having a very low voltage ranging from 0 to 5 V while a constant voltage is applied to an anode electrode and a gate electrode to control a field emission current. Compared with a conventional field emission device, the field emission device having a simple structure is capable of pulse driving and local dimming without using a separate pulse driving high voltage power source.

16 Claims, 5 Drawing Sheets

FIELD EMISSION DEVICE

CROSS-REFERENCE TO RELATED APPLICATION

This application claims priority to and the benefit of Korean Patent Application No. 10-2008-0129659, filed Dec. 18, 2008, the disclosure of which is incorporated herein by reference in its entirety.

BACKGROUND

1. Field of the Invention

The present invention relates to a field emission device, and more particularly, to a field emission device having a simple structure and capable of pulse driving and local dimming.

2. Discussion of Related Art

Generally, in a field emission device, a cathode substrate having a field emitter and an anode substrate having a fluorescent layer are spaced a predetermined distance apart to face each other and vacuum-packaged, and electrons emitted from the field emitter are collided with the fluorescent layer of the anode substrate to emit light due to cathode luminescence of the fluorescent layer.

In recent times, field emission devices have received great attention as lighting devices capable of substituting for back-light units of conventional liquid crystal display (LCD) devices, surface emitting devices and lighting apparatuses.

Particularly, cold cathode fluorescent lamps (CCFLs) and light emitting diodes (LEDs) have been generally used as back-light units of the conventional LCD devices.

However, the CCFL has a complicated configuration, and thus exacts high production costs. Further, since a light source is disposed at a side of the CCFL, a large amount of power is consumed during reflection and transmission of light. Further more, use of Hg causes environmental pollution, and uniformity in brightness becomes difficult to ensure as the LCD device becomes larger.

For these reasons, recently, a field emission device having low production costs, low power consumption and relatively uniform brightness in a wide emission range has been widely used as a back-light unit of the LCD device.

A conventional field emission device will be described in detail with reference to FIG. 1.

FIG. 1 is a view of a conventional top-gate field emission device 100 having a triode structure.

Referring to FIG. 1, the conventional field emission device 100 having a triode structure includes cathode and anode substrates 110 and 130 which are spaced a predetermined distance apart to face each other, a cathode electrode 111 formed on the cathode substrate 110, a plurality of field emitters 112 spaced a predetermined distance apart from each other on the cathode electrode 111, an anode electrode 131 formed on the anode substrate 130, a fluorescent layer 132 and a metal coating layer 133 which are formed on the anode electrode 131, a gate electrode 151 interposed between the cathode substrate 110 and the anode substrate 130 to induce electron emission from the field emitter 112, a gate insulating layer 150 configured to insulate the gate electrode 151, and a spacer 160 configured to maintain a space between the gate electrode 151 and the anode electrode 131.

The metal coating layer 133 serves to reflect light emitted by colliding with the fluorescent layer 132, and a plurality of openings 150*a* and 151*a* are respectively formed in the gate insulating layer 150 and the gate electrode 151 to transmit the electron emitted from the field emitter 112.

In the field emission device 100, when a voltage difference between the cathode electrode 111 and the gate electrode 151 is equal to or higher than a threshold voltage of the field emitter 112, an electron is emitted from the field emitter 112, accelerated due to several to several tens of kV of high voltage applied to the anode electrode 131, and then collides with the fluorescent layer 132, thereby emitting light.

When such a field emission device 100 is used as a back-light unit of the LCD device, the brightness of the back-light needs to be locally controlled according to images displayed on a screen. Thus, the field emission device 100 is constructed to be capable of local dimming, which will be described below.

FIG. 2 is a view illustrating a local dimming operation of the conventional field emission device 100 of FIG. 1.

Referring to FIG. 2, the cathode electrodes 111 are disposed perpendicular to the gate electrodes 151, and then a voltage is applied to these electrodes. At this time, a cathode voltage controller 170 and a gate voltage controller 180 control the voltage to make a predetermined voltage difference between only a specific cathode electrode 111 and a specific gate electrode 151, and thus electrons are emitted from only a specific region. For example, when a driving voltage equal to or higher than a threshold voltage of the field emitter 112 is applied between an $m^{th}$ cathode electrode 111 and an $n^{th}$ gate electrode 151, only region A of the field emitter 112 emits electrons.

Here, since continuous electron emission from the field emitter 112 may degrade the field emitter 112, an electron emission amount is generally controlled by applying a pulse-type voltage to the gate electrode 151.

However, in the pulse driving method, the local dimming operation requires several to several hundreds of V of high voltage pulse to be applied to the gate electrode 151. Thus, to apply such a high voltage pulse, a pulse driving high voltage power source is separately needed, which makes a driving circuit complicated, and increases production costs.

SUMMARY OF THE INVENTION

The present invention is directed to a field emission device having a simple structure and capable of pulse driving and local dimming.

More particularly, the present invention is directed to a field emission device having a simple structure and capable of pulse driving and local dimming by turning current applied to a plurality of cathode electrode blocks on or off in response to a switching control signal having a low voltage level while a constant voltage is applied to an anode electrode and a gate electrode.

One aspect of the present invention provides a field emission device including: a cathode substrate and an anode substrate, which are spaced a predetermined distance apart to face each other; a plurality of cathode electrode blocks electrically separated from each other on the cathode substrate, and a plurality of field emitters spaced a predetermined distance apart from each other on the respective cathode electrode blocks; an anode electrode formed on the anode substrate and a fluorescent layer formed on the anode electrode; a gate electrode interposed between the cathode substrate and the anode substrate to induce electron emission from the field emitter; a gate insulating layer interposed between the cathode electrode block and the gate electrode to insulate the gate electrode from the cathode electrode block; and a cathode current controller electrically connected to the cathode electrode blocks to control current flowing in the cathode electrode blocks.

The cathode current controller may include a plurality of current switching circuits connected one-to-one to the cathode electrode blocks to turn the current flowing from a corresponding cathode electrode block on or off, and a switching controller providing a pulse-type switching control signal swinging from a high level to a low level to the current switching circuit.

The current switching circuit may include a current switching device connected in series between the cathode electrode block and a ground, and overvoltage and overcurrent protection circuits protecting the cathode electrode block connected to the current switching device from overvoltage and overcurrent.

While a constant voltage is applied to the anode electrode and the gate electrode, and a pulse-type switching control signal swinging from a high level to a low level is applied to a predetermined current switching circuit, the corresponding switching circuit may be turned on only when the switching control signal may have a high level and thus current may flow from a cathode electrode block connected to the corresponding current switching circuit, and the corresponding switching circuit may be turned off when the switching control signal has a low level and thus current flow from a cathode electrode block connected to the corresponding switching circuit may be interrupted.

An amount of current flowing from each cathode electrode block may be controlled by a pulse width modulation (PWM) method using a fixed voltage level of the switching control signal and a variable on/off duty of the switching control signal, or an amount of current flowing from each cathode electrode block may be controlled by a pulse amplitude modulation (PAM) method using a fixed on/off duty of the switching control signal and a variable voltage level of the switching control signal.

That is, as the cathode current controller simply may turn the current applied to the cathode electrode block on or off in response to a switching control level having a low voltage level while a constant voltage is applied to the anode electrode and the gate electrode, the amount of electrons emitted from the field emitter formed on the cathode electrode block may be controlled, resulting in local dimming.

BRIEF DESCRIPTION OF THE DRAWINGS

The above and other objects, features and advantages of the present invention will become more apparent to those of ordinary skill in the art by describing in detail preferred embodiments thereof with reference to the attached drawings in which.

DETAILED DESCRIPTION OF EXEMPLARY EMBODIMENTS

Figure 1:
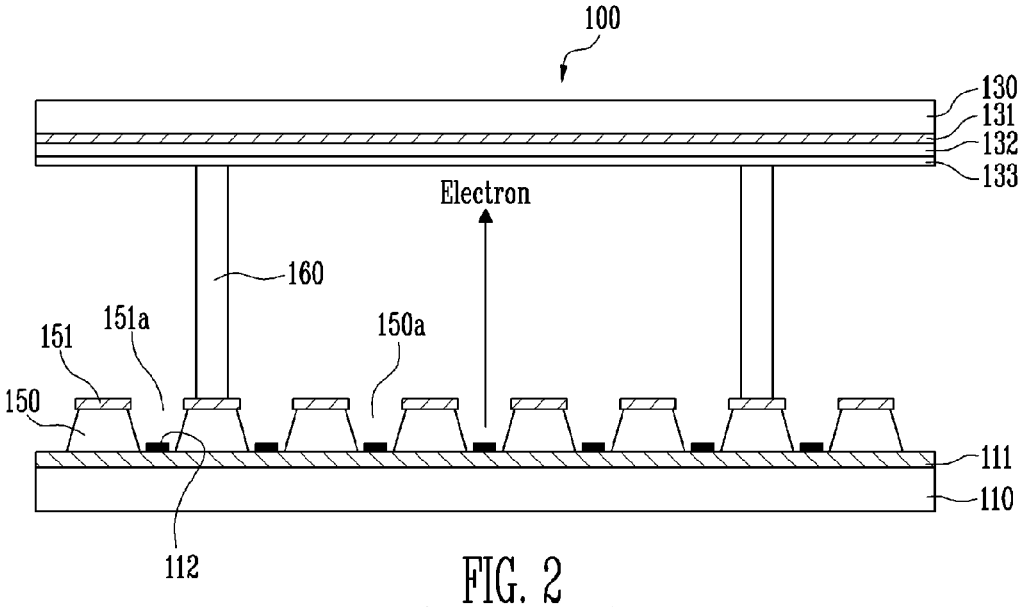
FIG. 1 (PRIOR ART)
FIG. 1 is a view of a conventional top-gate field emission device having a triode structure.
Figure 2:
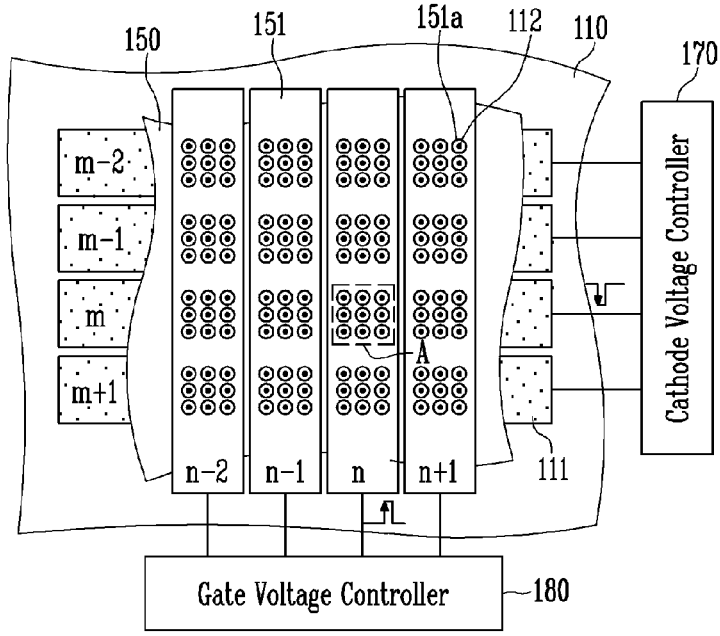
FIG. 2 (PRIOR ART)
FIG. 2 is a view illustrating a local dimming operation of the conventional field emission device illustrated in FIG. 1.

Hereinafter, the present invention will be described with reference to the accompanying drawings in detail. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout the specification. In the drawings, the thicknesses of layers and regions are exaggerated for clarity.

Figure 3:
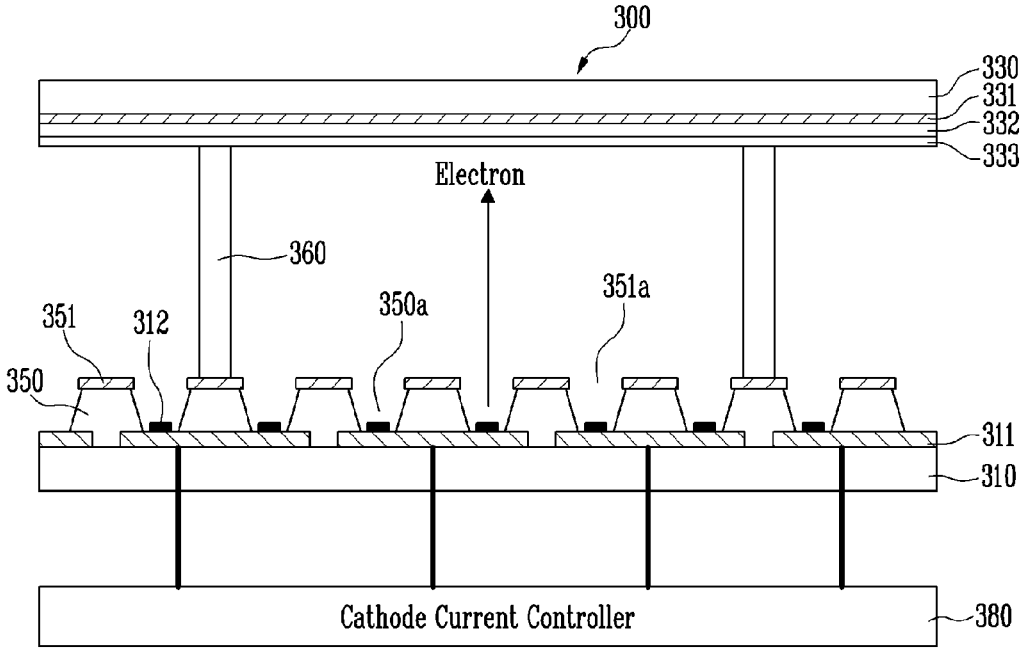
FIGS. 3 and 4 are views of a field emission device according to an exemplary embodiment of the present invention.
Figure 4:
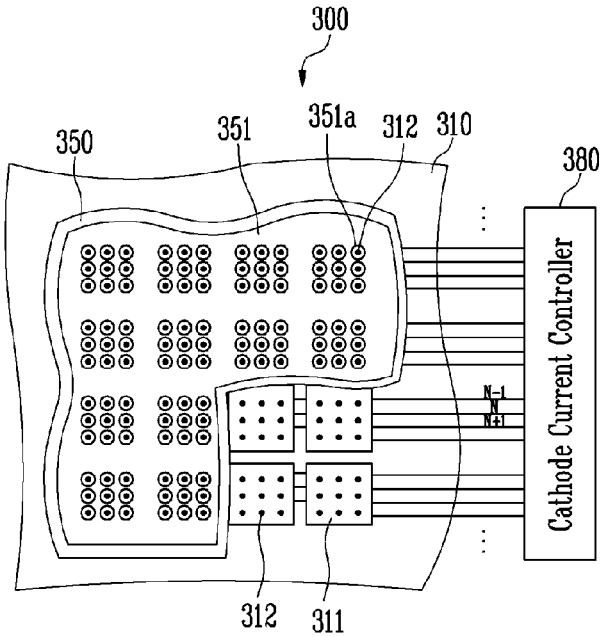

FIGS. 3 and 4 are views of a field emission device according to the present invention.

Referring to FIGS. 3 and 4, a field emission device 300 of an exemplary of the present invention includes cathode and anode substrates 310 and 330 which are spaced a predetermined distance apart to face each other, a plurality of cathode electrode blocks 311 formed to be electrically separated from each other on the cathode substrate 310, a plurality of field emitters 312 spaced a predetermined distance apart from each other on the respective cathode electrode block 311, an anode electrode 331 formed on the anode substrate 330, a fluorescent layer 332 and a metal coating layer 333 which are formed on the anode electrode 331, a gate electrode 351 interposed between the cathode substrate 310 and the anode substrate 330 to induce electron emission from the field emitter 312, a gate insulating layer 350 configured to insulate the gate electrode 351, a spacer 360 configured to maintain a distance between the gate electrode 351 and the anode electrode 331, and a cathode current controller 380 electrically connected to the cathode electrode block 311 to control current flowing in the cathode electrode block 311.

The field emitter 312 may be formed of an electron emitting material having an excellent electron emission characteristic, which may be a carbon nano tube, a carbon nano fiber or a carbon-based synthetic material.

The gate insulating layer 350 is formed between the cathode electrode block 311 and the gate electrode 351 to insulate the gate electrode 351 from the cathode electrode block 311. Here, the gate insulating layer 350 may be formed to a thickness of 0.5 to 2 times a diameter of an opening 351*a* in the gate electrode 351. For example, the gate insulating layer 350 is formed to a thickness of 1 to 200 μm between the cathode electrode block 311 and the gate electrode 351.

Preferably, a plurality of openings 350*a* and 351*a* are respectively formed in the gate insulating layer 350 and the gate electrode 351 so that the electrons emitted from the field emitter 312 can pass through them.

The field emission device 300 according to the present invention performs pulse driving and local dimming by controlling an amount of current flowing from a predetermined cathode electrode block 311 by the cathode current controller 380 while a constant voltage is applied to the anode electrode 331 and the gate electrode 351. A field emission structure of the present invention will be described in detail below.

Figure 5:
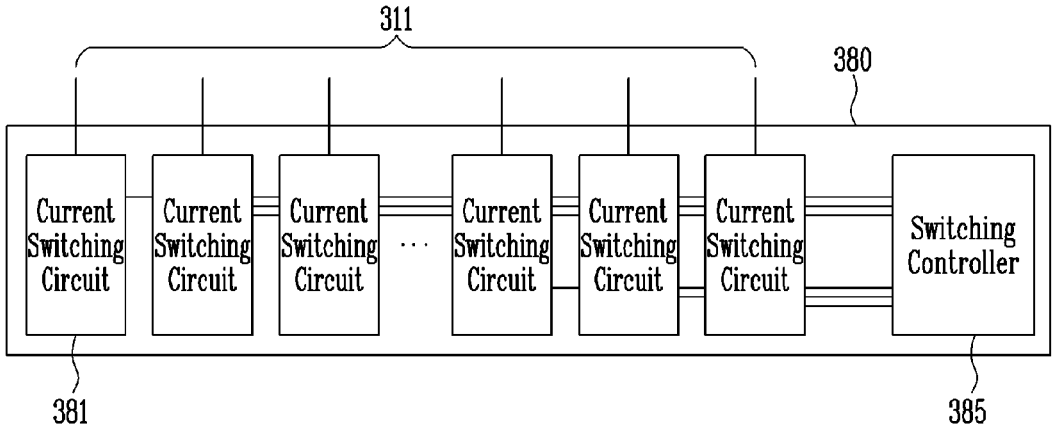
FIG. 5 is a view illustrating the configuration and operation of a cathode current controller in the field emission device according to an exemplary embodiment of the present invention.
Figure 6:
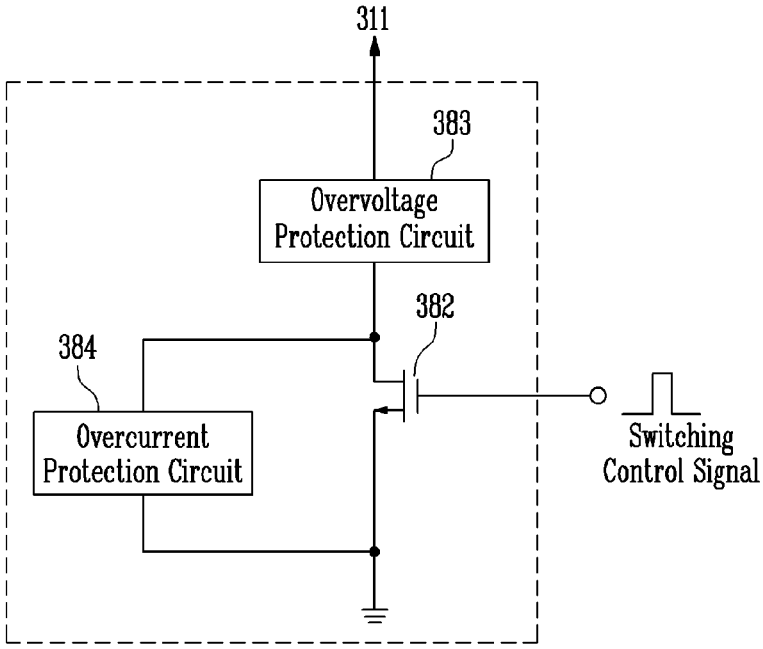
FIG. 6 is a detailed circuit diagram of a current switching circuit illustrated in FIG. 5.

FIG. 5 is a view illustrating the configuration and operation of the cathode current controller in the field emission device according to an exemplary embodiment of the present invention, and FIG. 6 is a detailed circuit diagram of a current switching circuit illustrated in FIG. 5.

Referring to FIG. 5, the cathode current controller 380 includes a plurality of current switching circuits 381 connected one-to-one to the cathode electrode blocks 311 to turn the current flowing from the corresponding cathode electrode block 311 on or off, and a switching controller 385 providing a pulse-type switching control signal swinging from a high level to a low level to the current switching circuit 381.

Here, the switching control signal has a voltage value having a high or low level from 0 to 5 V.

Referring to FIG. 6, the current switching circuit 381 includes a current switching device 382 connected in series between the cathode electrode block 311 and a ground, and an overvoltage protection circuit 383 and an overcurrent protection circuit 384 which protect the cathode electrode block 311 connected to the current switching device 382 from overvoltage and overcurrent.

The current switching device 382 may be a high voltage transistor, in which the switching control signal is input to a gate terminal thereof, the cathode electrode block 311 is connected to a drain terminal thereof, and the ground is connected to a source terminal thereof.

The overvoltage protection circuit 383 and the overcurrent protection circuit 384 are connected to the drain terminal of the high voltage transistor, and prevent application of the overvoltage and overcurrent to the cathode electrode block 311. Here, the overvoltage protection circuit 383 may be connected in series to a resistor, a varistor or a reactor, and the overcurrent protection circuit 384 may be connected in parallel to a Zener diode.

Referring again to FIG. 5, when a switching control signal of a high level from the switching controller 385 is applied to a predetermined current switching circuit 381 for a predetermined period of time, the corresponding current switching circuit 381 is turned, and thus current flows from only the cathode electrode block 311 connected to the corresponding current switching circuit 381 for a predetermined period of time, resulting in occurrence of field emission from only the field emitter 312 on the corresponding cathode electrode block 311. When a switching control signal of a low level from the switching controller 385 is applied to a predetermined current switching circuit 381, the corresponding current switching circuit 381 is turned off, and thus current flow from the cathode electrode block 311 connected to the corresponding current switching circuit 381 is interrupted, resulting in stopping field emission from the field emitter 312 on the corresponding cathode electrode block 311.

That is, since the field emission device 300 according to the present invention has a structure capable of local dimming by the unit of the cathode electrode block 311, an amount of the electrons emitted from the field emitter 312 on the corresponding cathode electrode block 311 can be controlled by controlling an amount of the current flowing in each cathode electrode block 311. Accordingly, it is possible to represent a specific gray scale Here, the amount of the electrons emitted from the field emitter 312 on each cathode electrode block 311 may be controlled using a PWM or PAM method, which will be described in detail.

Figure 7:
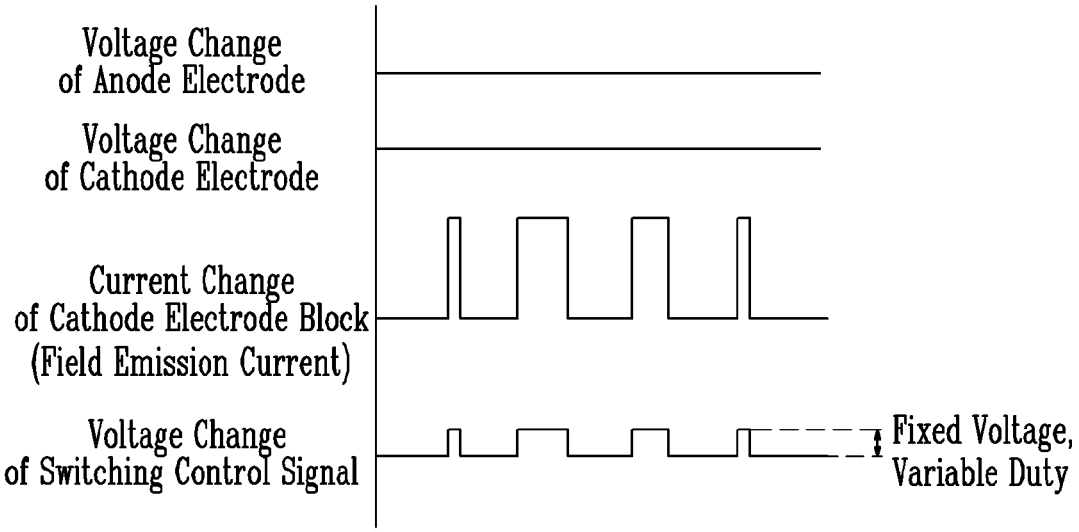
FIGS. 7 and 8 illustrate changes in current (field emission current) flowing in a corresponding cathode electrode block in response to a switching control signal generated from a cathode current controller according to times when the field emission device in accordance with an exemplary embodiment of the present invention is operated in a pulse width modulation (PWM) method or a pulse amplitude modulation (PAM) method.
Figure 8:
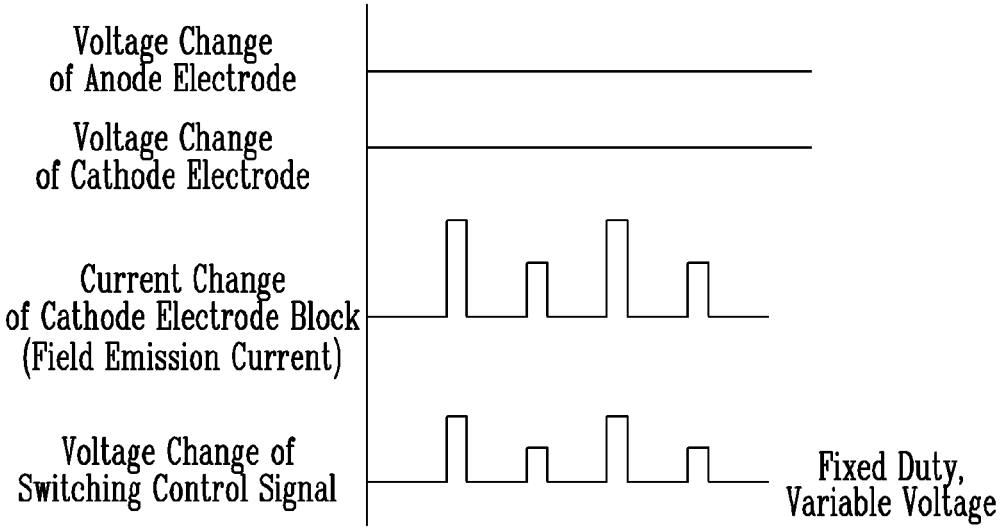

FIGS. 7 and 8 illustrate changes in current (field emission current) flowing in the corresponding cathode electrode block in response to a switching control signal generated from the cathode current controller according to times when the field emission device in accordance with an exemplary embodiment of the present invention is operated in the PWM or the PAM method.

Referring to FIGS. 7 and 8, while a constant voltage is applied to the anode electrode 331 and the gate electrode 351, and a pulse-type switching control signal swinging from a high level to a low level is applied to the predetermined current switching circuit 381, current flows from the corresponding cathode electrode block 311 while the switching control signal has a high level, resulting in field emission from the field emitter 312 on the corresponding cathode electrode block 311. However, while a switching control signal has a low level, current does not flow from the corresponding cathode electrode block 311.

Here, in the PWM method, an on/off duty is controlled at a fixed voltage level of the switching control signal, and thus an amount of the electrons emitted from the field emitter 312 is controlled. In the PAM method, a voltage level of the switching control signal is varied at a fixed on/off duty of the switching control signal, and thus an amount of the electrons emitted from the field emitter 312 is controlled.

Figure 9:
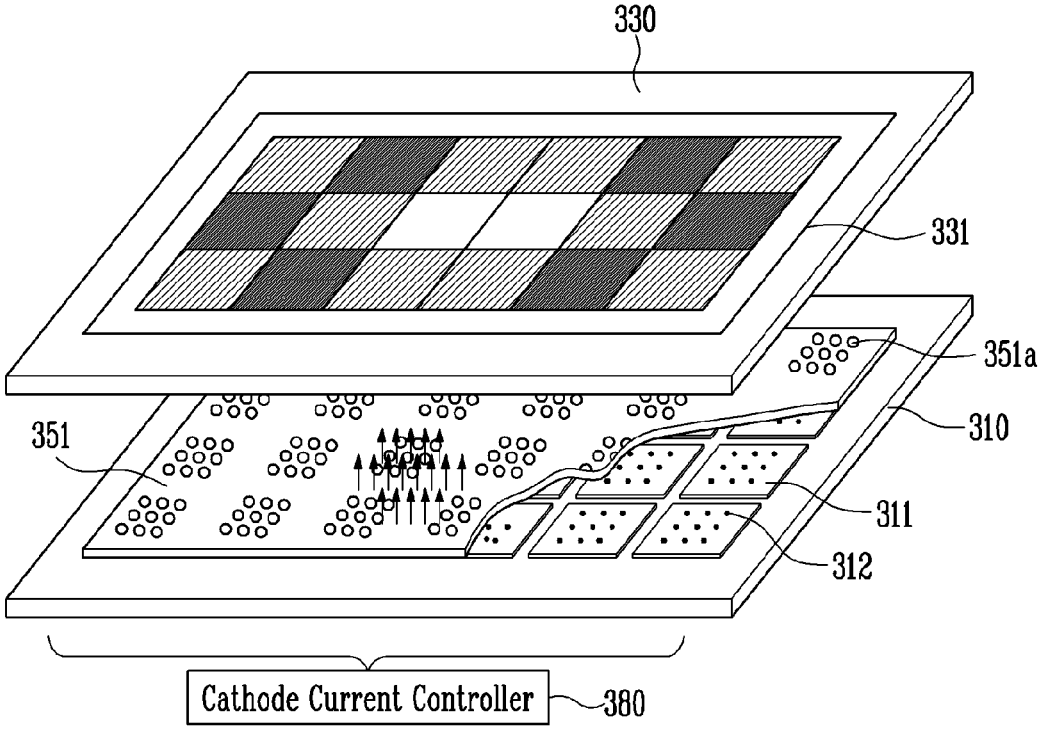
FIG. 9 is a view illustrating a local dimming state of the field emission device according to an exemplary embodiment of the present invention the present invention.

FIG. 9 is a view illustrating a local dimming state of the field emission device according to the present invention.

As illustrated in FIG. 9, while a constant voltage is applied to the anode electrode 331 and the gate electrode 351, and amounts of current flowing from the plurality of cathode electrode blocks 311 electrically separated from each other are controlled by the cathode current controller 380, an amount of electrons emitted from the field emitter 312 formed on each cathode electrode block 311 may be controlled, resulting in a partial control in brightness.

As a result, in the field emission device 300 according to the present invention, field emission current can be controlled by turning the current flowing from each cathode electrode block 311 on or off in response to a switching control signal having a very low voltage ranging from 0 to 5 V while a constant voltage is applied to the anode electrode 331 and the gate electrode 351, unlike the conventional pulse driving method to perform field emission from the field emitter in a specific region for a predetermined period of time by applying several to several hundreds of V of high voltage pulse to the cathode electrode and the gate electrode. Accordingly, the field emission device 300 according to the present invention can have a simple structure compared to the conventional field emission device without having a separate pulse driving high voltage power and perform pulse driving and local dimming According to the present invention, a field emission device can be embodied, which is capable of pulse driving and local dimming by simply turning current flowing in a plurality of cathode electrode blocks on or off using a switching control signal of a low voltage level. Thus, an expensive pulse driving high voltage power source is not required so that production costs of the field emission device can be reduced.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A field emission device, comprising:

a cathode substrate;

an anode substrate, the anode and cathode substrates being spaced apart to face each other;

a plurality of cathode electrode blocks electrically separated from each other on the cathode substrate, wherein the cathode electrode blocks include a first cathode electrode block, a second cathode electrode block and a third cathode electrode block, the second cathode electrode block is disposed in a first direction from the first cathode electrode block, the third cathode electrode block is disposed in a second direction from the first cathode electrode block, and the first direction is different from the second direction;

a plurality of field emitters spaced apart from each other on the cathode electrode blocks, each of the cathode electrode blocks having a group of the field emitters disposed thereupon;

an anode electrode formed on the anode substrate;

a fluorescent layer formed on the anode electrode;

a gate electrode interposed between the cathode substrate and the anode substrate, the gate electrode having a constant gate voltage applied thereto and being disposed for inducing electron emission from all of the field emitters, wherein the gate electrode is the only gate electrode included in the field emission device and is continuously disposed over all of the cathode electrode blocks;

a gate insulating layer interposed between the cathode electrode blocks and the gate electrode to insulate the gate electrode from the cathode electrode blocks; and a cathode current controller electrically connected to the cathode electrode blocks to control current flowing in the cathode electrode blocks so as to control an amount of electron emission from one or more of the field emitters as the gate voltage is kept constant.

2. The field emission device according to claim 1, wherein each of the switching control signals has values for the high and low levels between 0 to 5 V.

3. The field emission device according to claim 2, wherein while the constant anode voltage is applied to the anode electrode and the constant gate voltage is applied to the gate electrode, and one of the pulse-type switching control signals is applied to a predetermined current switching circuit, the predetermined current switching circuit is turned on only when the one switching control signal has a high level, and thus current flows in the one cathode electrode block connected to the predetermined current switching circuit.

4. The field emission device according to claim 3, wherein the predetermined current switching circuit is turned off when the one switching control signal has a low level, and thus current flow to the one cathode electrode block is interrupted.

5. The field emission device according to claim 3, wherein an amount of the current flowing in the one cathode electrode block is controlled by a pulse width modulation (PWM) method using a variable on/off duty of the one switching control signal and a fixed voltage level of the one switching control signal.

6. The field emission device according to claim 3, wherein an amount of the current flowing in the one cathode electrode block is controlled by a pulse amplitude modulation (PAM) method using a variable voltage level of the one switching control signal and a fixed on/off duty of the one switching control signal.

7. The field emission device according to claim 1, wherein a plurality of openings are formed in the gate insulating layer and the gate electrode to allow electrons emitted from the field emitters to pass through them.

8. The field emission device according to claim 7, wherein the gate insulating layer is formed to have a thickness of 0.5 to 2 times a diameter of one of the openings of the gate electrode.

9. The field emission device according to claim 8, wherein the gate insulating layer is formed to a thickness of 1 to 200 μm between the cathode electrode block and the gate electrode.

10. The field emission device according to claim 1, wherein the field emitters are each formed of one of carbon nano tubes, carbon nano fibers and carbon-based synthetic materials.

11. The field emission device according to claim 1, wherein at a first time and while the gate voltage is kept constant, the cathode current controller controls current flowing in the first and second cathode electrode blocks so that the field emitters on the first cathode electrode block emit electrons and the field emitters on the second cathode electrode block do not emit electrons.

12. The field emission device according to claim 11, wherein at a second time and while the gate voltage is kept constant, the cathode current controller controls current flowing in the first and second cathode electrode blocks so that field emitters on the second cathode electrode block emit electrons and field emitters on the first cathode electrode block do not emit electrons.

13. The field emission device according to claim 1, wherein the cathode electrode blocks includes a fourth cathode electrode block, further wherein the first and second cathode electrode blocks are disposed on a first straight line and the first and third cathode electrode blocks are disposed on a second straight line perpendicular to the first straight line, further wherein the third and fourth cathode electrode blocks are disposed on a third straight line parallel to the first straight line, and further wherein the second and fourth cathode electrode blocks are disposed on a fourth straight line parallel to the second straight line.

14. A field emission device, comprising:

a cathode substrate;

an anode substrate, the anode and cathode substrates being spaced apart to face each other;

a plurality of cathode electrode blocks electrically separated from each other on the cathode substrate;

a plurality of field emitters spaced apart from each other on the cathode electrode blocks;

an anode electrode formed on the anode substrate;

a fluorescent layer formed on the anode electrode;

a gate electrode interposed between the cathode substrate and the anode substrate to induce electron emission from one or more of the field emitters;

a gate insulating layer interposed between the cathode electrode blocks and the gate electrode to insulate the gate electrode from the cathode electrode blocks;

a cathode current controller electrically connected to the cathode electrode blocks to control current flowing in the cathode electrode blocks, wherein while constant voltages are applied to each of the anode electrode and the gate electrode, the cathode current controller turns the current applied to the cathode electrode blocks on or off to control an amount of electron emission from the field emitters resulting in local dimming, wherein the cathode current controller includes a plurality of current switching circuits connected one-to-one to the cathode electrode blocks to turn the current flowing in the corresponding cathode electrode blocks on or off, wherein one of the current switching circuits includes a current switching device connected in series between the corresponding cathode electrode block and a ground, and overvoltage and overcurrent protection circuits protecting the corresponding cathode electrode block connected to the current switching device from overvoltage and overcurrent; and a switching controller providing pulse-type switching control signals, that each swing from a high level to a low level, to the current switching circuits.

15. The field emission device according to claim 14, wherein the current switching device is a high voltage transistor, one of the switching control signals is input to a gate terminal of the high voltage transistor, the corresponding cathode electrode block is connected to a drain terminal thereof, and the ground is connected to a source terminal thereof.

16. The field emission device according to claim 14, wherein the overvoltage protection circuit is connected in series to a resistor, a varistor or a reactor, and the overcurrent protection circuit is connected in parallel to a Zener diode.

* * * * *